US008909366B2

(12) United States Patent
Okuyama

(10) Patent No.: US 8,909,366 B2
(45) Date of Patent: Dec. 9, 2014

(54) SEWING MACHINE AND COMPUTER PROGRAM PRODUCT

(75) Inventor: Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 574 days.

(21) Appl. No.: 13/279,831

(22) Filed: Oct. 24, 2011

(65) Prior Publication Data

US 2012/0109357 A1 May 3, 2012

(30) Foreign Application Priority Data

Oct. 28, 2010 (JP) ..... 2010-242019

(51) Int. Cl.
*G06F 7/66* (2006.01)
*D05C 11/16* (2006.01)

(52) U.S. Cl.
CPC ..... *D05C 11/16* (2013.01)
USPC ..... 700/136; 112/470.01; 700/138

(58) Field of Classification Search
CPC ..... D05C 11/16; D05C 5/00; D05C 5/02; D05C 3/02; D05B 43/00; D05B 19/04; D05B 19/08; D05B 19/085; D05B 19/10; D05B 19/105; D05B 19/12; D05D 2205/12; D05D 2205/16; D05D 2205/18
USPC ..... 700/136–138; 112/102.5, 445, 470.01, 112/470.04
See application file for complete search history.

(56) References Cited

U.S. PATENT DOCUMENTS 4,531,467 A 7/1985 Golia, Jr. et al.
5,794,552 A * 8/1998 Owaki ..... 112/102.5
5,904,109 A 5/1999 Asano
6,012,402 A * 1/2000 Sekine ..... 112/102.5
7,806,063 B2 10/2010 Shimizu
2005/0188906 A1 9/2005 Goto et al.
2007/0227421 A1 10/2007 Nomura et al.
2007/0295253 A1 * 12/2007 Hayakawa et al. ..... 112/102.5

FOREIGN PATENT DOCUMENTS

EP 0 921 255 A1 6/1999
JP A-2002-292172 10/2002
JP A-2005-73866 3/2005
JP A-2007-275103 10/2007
JP A-2007-313159 12/2007

OTHER PUBLICATIONS

Mar. 6, 2012 Partial Extended European Search Report issued in European Patent Application No. 11186924.4.

* cited by examiner

*Primary Examiner* — Nathan Durham
(74) *Attorney, Agent, or Firm* — Oliff PLC

(57) ABSTRACT

A sewing machine includes a plurality of needle bars to a lower end of each of which a needle can be attached, a display portion that is configured to display various information, a first display control portion that causes the display portion to display replacement information, the replacement information being information pertaining to a replacement needle bar that corresponds to a thread spool for which replacement is necessary and that is at least one of the plurality of the needle bars, a specifying portion that specifies a replacement-completed needle bar during a period in which the replacement information is being displayed on the display portion, the replacement-completed needle bar being a needle bar that corresponds to a thread spool that has been placed after replacement, and a second display control portion that causes the display portion to display a result that has been specified by the specifying portion.

4 Claims, 11 Drawing Sheets

FIG. 5

| NEEDLE BAR NUMBER | THREAD COLOR |
|---|---|
| 1 | LIGHT BROWN |
| 2 | GREEN |
| 3 | BLUE |
| 4 | ORANGE |
| 5 | TANGERINE |
| 6 | RED |
| 7 | PINK |
| 8 | LILAC |
| 9 | ELECTRIC BLUE |
| 10 | BLACK |

FIG. 6

| SEWING ORDER | THREAD COLOR |
|---|---|
| 1 | LIGHT BROWN |
| 2 | EMERALD GREEN |
| 3 | LIME GREEN |
| 4 | YELLOW |
| 5 | TANGERINE |
| 6 | RED |
| 7 | PINK |
| 8 | LILAC |
| 9 | ELECTRIC BLUE |
| 10 | BLACK |

SEWING MACHINE AND COMPUTER PROGRAM PRODUCT

CROSS-REFERENCE TO RELATED APPLICATION

This application claims priority to Japanese Patent Application No. 2010-242019, filed Oct. 28, 2010, the content of which is hereby incorporated herein by reference.

BACKGROUND

The present disclosure relates to a sewing machine that is capable of sewing an embroidery pattern that is to be sewn with threads of a plurality of colors and to a computer program product.

A sewing machine is known that is capable of sewing an embroidery pattern that is to be sewn with threads of a plurality of colors. In processing that sews the embroidery pattern in the plurality of colors, it may be necessary to replace a thread spool. The known sewing machine may control a display portion that is provided in the vicinity of a spool stand and a thread guide path member and that corresponds to a needle bar for which the thread spool must be replaced to display the color for the thread spool that is to be attached to a spool pin.

SUMMARY

In the known sewing machine that is described above, a display form of the display portion for the needle bar for which the thread spool must be replaced is different from a display form of a display portion for a needle bar for which replacement of the thread spool has already been completed and a display form of a display portion for a needle bar for which replacement of the thread spool is not necessary. Therefore, with the known sewing machine, in order to distinguish between the needle bar for which the thread spool must be replaced and a needle bar for which replacement of the thread spool has already been completed, a user must check each of the display portions that respectively correspond to a plurality of the needle bars.

Various embodiments of the broad principles derived herein provide a sewing machine and a computer program product that improve convenience for a user when a thread spool is replaced.

Embodiments provide a sewing machine that includes a plurality of needle bars to a lower end of each of which a needle can be attached, the needle having a needle eye through which can be passed an upper thread that is supplied from a thread spool, a display portion that is configured to display various information, and a first display control portion that causes the display portion to display replacement information. The replacement information is information pertaining to a replacement needle bar that corresponds to a thread spool for which replacement is necessary and that is at least one of the plurality of the needle bars. The sewing machine also includes a specifying portion that specifies a replacement-completed needle bar during a period in which the replacement information is being displayed on the display portion. The replacement-completed needle bar is a needle bar that corresponds to a thread spool that has been placed after replacement. The sewing machine further includes a second display control portion that causes the display portion to display a result that has been specified by the specifying portion.

Embodiments also provide a computer program product stored on a non-transitory computer-readable medium. The computer program product includes instructions for causing a computer of a sewing machine to execute the steps of causing a display portion of the sewing machine to display replacement information. The display portion is configured to display various information. The replacement information is information pertaining to a replacement needle bar that corresponds to a thread spool for which replacement is necessary and that is at least one of a plurality of the needle bars of the sewing machine. A needle can be attached to a lower end of each of the plurality of the needle bars. The needle has a needle eye through which can be passed an upper thread that is supplied from a thread spool. The computer program product also includes instructions for causing a computer of a sewing machine to execute the steps of specifying a replacement-completed needle bar during a period in which the replacement information is being displayed on the display portion, the replacement-completed needle bar being a needle bar that corresponds to a thread spool that has been placed after replacement, and causing the display portion to display a result that has been specified.

BRIEF DESCRIPTION OF THE DRAWINGS

Embodiments will be described below in detail with reference to the accompanying drawings in which:

FIG. 5 is a table that shows colors of threads on thread spools that respectively correspond to needle bars 31 with needle bar numbers 1 to 10 when the main processing starts;

FIG. 6 is a table that shows correspondences between a sewing order and thread colors for sewing an embroidery pattern that has been selected;

DETAILED DESCRIPTION

Hereinafter, a multi-needle sewing machine (hereinafter referred to as a "sewing machine") 1 that is an embodiment of the present disclosure will be explained with reference to the drawings.

Figure 2:
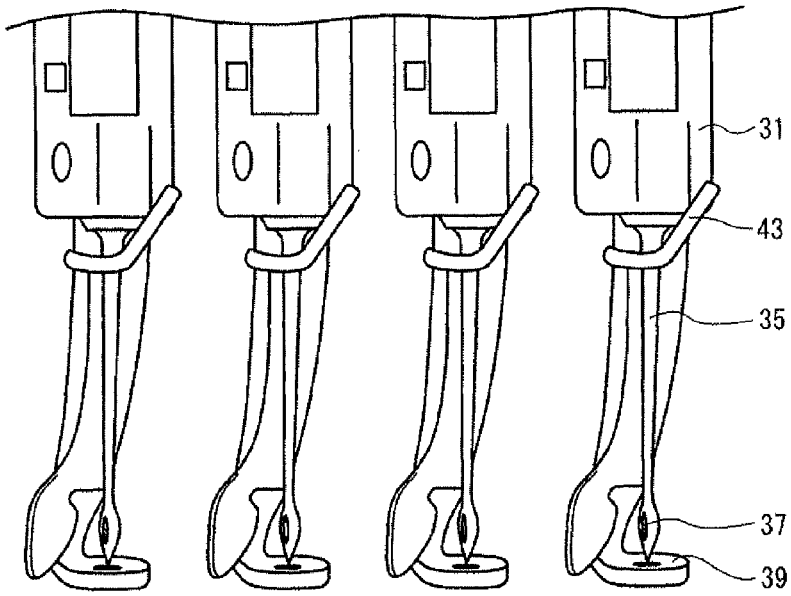
FIG. 2 is an enlarged oblique view of an area around a needle 35.
Figure 3:
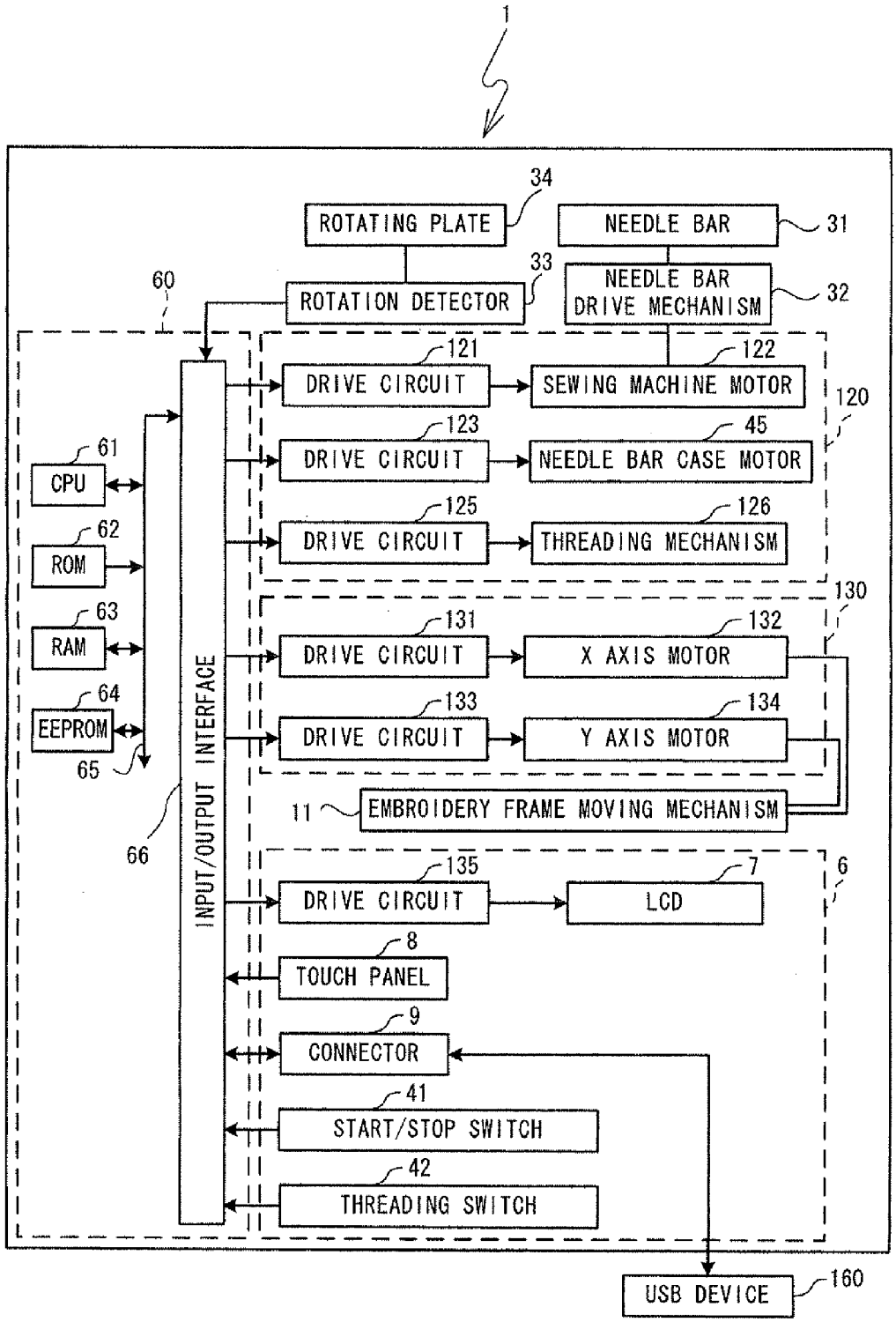
FIG. 3 is a block diagram that shows an electrical configuration of the multi-needle sewing machine 1.

The physical configuration of the sewing machine 1 will be explained with reference to FIGS. 1 to 3. In the explanation that follows, in FIG. 1, the lower left side, the upper right side, the upper left side, and the lower right side of the page respectively correspond to the front side, the rear side, the left side, and the right side of the sewing machine 1.

Figure 1:
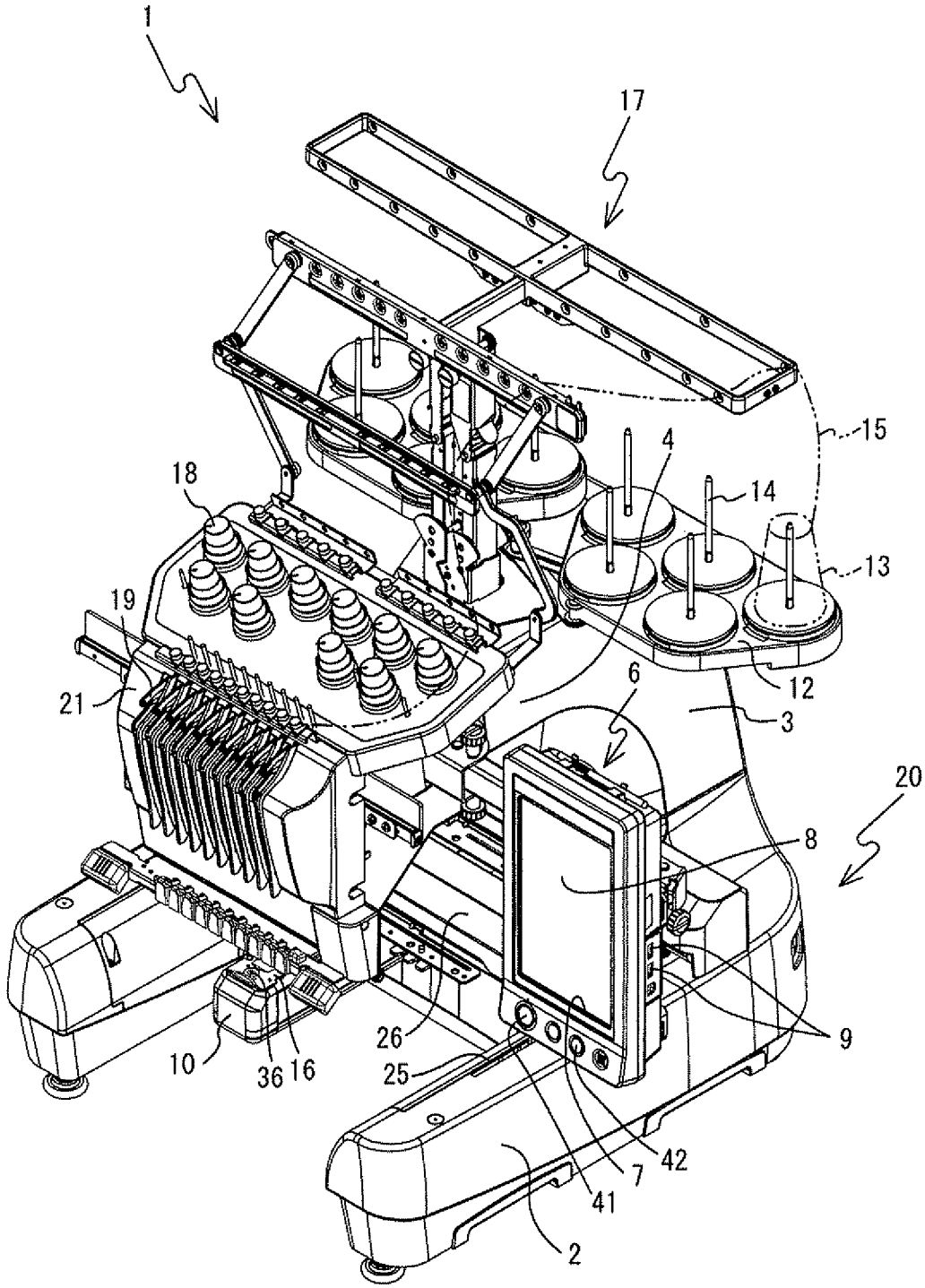
FIG. 1 is an oblique view of a multi-needle sewing machine 1.

As shown in FIG. 1, a body 20 of the sewing machine 1 includes a support portion 2, a pillar 3, and an arm 4. The support portion 2 is formed in an inverted U shape in a plan view and supports the entire sewing machine 1. A left-right pair of guide slots 25 that extend in the front-rear direction are provided in the top face of the support portion 2. The pillar 3 extends upward from the rear edge of the support portion 2. The arm 4 extends toward the front from the upper end of the pillar 3. A needle bar case 21 is mounted on the front end of the arm 4 such that the needle bar case 21 can be moved in the left-right direction. Ten needle bars 31 (refer to FIG. 3) that extend in the up-down direction are disposed at equal intervals in the left-right direction in the interior of the needle bar case 21. A needle bar number is assigned to each of the needle bars 31 for identifying the individual needle bars 31. In the present embodiment, needle bar numbers 1 to 10 are assigned in order starting from the right side of the sewing machine 1. Among the ten needle bars 31, one of the needle bars 31 that is in a sewing position may be slid in the up-down direction by a needle bar drive mechanism 32 (refer to FIG. 3). The needle bar drive mechanism 32 is provided in the interior of the needle bar case 21. As shown in FIG. 2, needles 35 may be attached to the lower ends of the needle bars 31. A presser foot 39 may operate in conjunction with the up-down movement of the needle bars 31 and may intermittently press downward on a sewing object (for example, a work cloth).

An operation portion 6 is provided to the right of the central portion of the arm 4 in the front-rear direction. The operation portion 6 is rotatably supported by the arm 4, with its axis of rotation being a shaft (not shown in the drawings) that extends in the up-down direction. The operation portion 6 includes a liquid crystal display (LCD) 7, a touch panel 8, connectors 9, a start/stop switch 41, and a threading switch 42. Various types of information, such as an operation screen that is used when a user inputs a command, may be displayed on the LCD 7. The touch panel 8 is used for accepting a command from the user. The user may select and set various types of conditions, such as a sewing pattern and sewing conditions, by using the user's finger or a stylus pen to press a location on the touch panel 8 that corresponds to a position of an input key or the like that is displayed on the LCD 7. The pressing of a location on the touch panel 8 using the user's finger or a stylus pen is hereinafter referred to as a "panel operation". The connectors 9 are USB-standard connectors, and a USB device 160 (refer to FIG. 3) can be connected to one of the connectors 9. The start/stop switch 41 is used to issue a command to start and stop the sewing. In a case where the start/stop switch 41 is pressed while the sewing is stopped, the sewing is started. In a case where the start/stop switch 41 is pressed while the sewing is in progress, the sewing is stopped. The threading switch 42 is used to issue a command to operate a threading mechanism 126 (refer to FIG. 3).

A cylindrical cylinder bed 10 that extends toward the front from the lower end of the pillar 3 is provided below the arm 4. A shuttle (not shown in the drawings) is provided in the interior of the front end portion of the cylinder bed 10. The shuttle may contain a bobbin (not shown in the drawings), around which a lower thread (not shown in the drawings) is wound. A shuttle drive mechanism (not shown in the drawings) is provided in the interior of the cylinder bed 10. The shuttle drive mechanism (not shown in the drawings) may rotationally drive the shuttle. A needle plate 16, which is rectangular in a plan view, is provided on the top face of the cylinder bed 10. A needle hole 36, which the needle 35 (refer to FIG. 2) may pass through, is provided in the needle plate 16.

A Y carriage 26 of an embroidery frame moving mechanism 11 (refer to FIG. 3) is provided below the arm 4. The embroidery frame moving mechanism 11 may support an embroidery frame (not shown in the drawings) such that the embroidery frame can be attached to and detached from the embroidery frame moving mechanism 11. The embroidery frame may hold the sewing object. The embroidery frame moving mechanism 11 may move the embroidery frame in the front-rear and left-right directions using an X axis motor 132 (refer to FIG. 3) and a Y axis motor 134 (refer to FIG. 3) as drive sources.

A left-right pair of spool stands 12 are provided on the rear side of the top face of the arm 4. Five spool pins 14 are provided on each of the spool stands 12. The spool pins 14 are pins that extend in the up-down direction. The spool pins 14 may support thread spools 13. Ten of the thread spools 13, the same number as the number of the needle bars 31, may be disposed on the pair of the spool stands 12. Upper threads 15 may be supplied from the thread spools 13 that are disposed on the spool stands 12. The upper threads 15 are supplied through thread guide paths to needle eyes 37 of the individual needles 35 that are attached to the lower ends of the needle bars 31. Each of the thread guide paths includes a thread guide 17, a tensioner 18, a thread take-up lever 19, and a needle bar thread guide 43. Although not shown in detail in the drawings, each of the tensioners 18 includes a rotating plate 34 (refer to FIG. 3) and a rotation detector 33 (refer to FIG. 3) in the interior of the each of the tensioners 18. For example, Japanese Laid-Open Patent Publication No. 2007-313159 discloses a tensioner, the relevant portions of which are incorporated by reference. The rotating plate 34 may impart tension to the upper thread 15. The rotation detector 33 may input to a control portion 60 (refer to FIG. 3) an electrical signal that indicates an amount of rotation of the rotating plate 34.

An electrical configuration that performs overall control of the sewing machine 1 will be explained with reference to FIG. 3. As shown in FIG. 3, the sewing machine 1 includes the rotation detector 33, a needle drive portion 120, a sewing object drive portion 130, the operation portion 6, and the control portion 60.

The needle drive portion 120 includes drive circuits 121, 123, 125, a sewing machine motor 122, a needle bar case motor 45, and the threading mechanism 126. The sewing machine motor 122 may move one of the needle bars 31 reciprocally in the up-down direction by driving the needle bar drive mechanism 32. The drive circuit 121 may drive the sewing machine motor 122 in accordance with a control signal from the control portion 60. The needle bar case motor 45 may move the needle bar case 21 in the left-right direction. The drive circuit 123 may drive the needle bar case motor 45 in accordance with a control signal from the control portion 60. The threading mechanism 126 is provided below the front end of the arm 4, although not shown in detail in the drawings. The threading mechanism 126 is used for passing the upper thread 15 (refer to FIG. 1) through the needle eye 37 of the needle 35 that is attached to the needle bar 31 (the needle bar for the sewing) that is positioned directly above the needle hole 36. For example, Japanese Laid-Open Patent Publication No. 2005-73866 discloses a threading mechanism, the relevant portions of which are incorporated by reference. The drive circuit 125 may drive the threading mechanism 126 in accordance with a control signal from the control portion 60.

The sewing object drive portion 130 includes drive circuits 131, 133, the X axis motor 132, and the Y axis motor 134. The X axis motor 132 may move the embroidery frame (not shown in the drawings) in the left-right direction by driving the embroidery frame moving mechanism 11. The drive circuit 131 may drive the X axis motor 132 in accordance with a control signal from the control portion 60. The Y axis motor 134 may move the embroidery frame (not shown in the drawings) in the front-rear direction by driving the embroidery frame moving mechanism 11. The drive circuit 133 may drive the Y axis motor 134 in accordance with a control signal from the control portion 60.

The operation portion 6 includes the touch panel 8, the connectors 9, a drive circuit 135, the LCD 7, the start/stop switch 41, and the threading switch 42. The drive circuit 135 may drive the LCD 7 in accordance with a control signal from the control portion 60. Each of the connectors 9 is provided with a function for connecting with the USB device 160. The USB device 160 may be a personal computer or a USB memory, for example.

The control portion 60 includes a CPU 61, a ROM 62, a RAM 63, an EEPROM 64, and an input/output interface 66, all of which are connected to one another by a bus 65. The rotation detector 33, the needle drive portion 120, the sewing object drive portion 130, and the operation portion 6 are connected to the input/output interface 66.

The CPU 61 performs main control of the sewing machine 1. The CPU 61 may perform various types of computations and processing that are related to sewing, in accordance with various types of programs that are stored in a program storage area (not shown in the drawings) of the ROM 62. The ROM 62 includes a plurality of storage areas that include the program storage area and a pattern storage area, although not shown in the drawings. Various types of programs for operating the sewing machine 1, including a main program, are stored in the program storage area. The main program is a program for performing main processing, which will be described below. Sewing data for sewing an embroidery pattern that is to be sewn with threads of a plurality of colors are stored in the pattern storage area. The RAM 63 is a storage element from and to which data can be read and written as desired. As necessary, the RAM 63 includes a storage area that stores computation results and the like from computational processing by the CPU 61. The EEPROM 64 is a storage element from and to which data can be read and written. Various types of parameters for performing various types of processing by the sewing machine 1 are stored in the EEPROM 64. In addition, the colors of the upper threads 15 that is to be supplied to the needle eyes 37 of the needles 35 that are attached to the lower ends of the individual needle bars 31 are stored in the EEPROM 64 in association with the individual needle bars 31.

An operation that forms a stitch in the sewing object that is held by the embroidery frame (not shown in the drawings) will be explained with reference to FIGS. 1 to 3. The embroidery frame that holds the sewing object may be supported by the embroidery frame moving mechanism 11. One of the ten needle bars 31 may be selected by the moving of the needle bar case 21 to the left or the right. The embroidery frame may be moved to a specified position by the embroidery frame moving mechanism 11. When the drive shaft (not shown in the drawings) is rotationally driven by the sewing machine motor 122, the needle bar drive mechanism 32 and a thread take-up lever drive mechanism (not shown in the drawings) are driven, such that the selected needle bar 31 and the corresponding thread take-up lever 19 are driven up and down. The shuttle drive mechanism is also driven by the rotation of the sewing machine motor 122, such that the shuttle is rotationally driven. Thus the needle 35, the thread take-up lever 19, and the shuttle are driven in synchronization with one another, so that a stitch may be formed in the sewing object.

The main processing that the sewing machine 1 performs will be explained with reference to FIGS. 4 to 10. The main processing is started when a command has been input to set a selection of an embroidery pattern that is to be sewn. Information that pertains to the embroidery pattern (for example, sewing data) is stored in the ROM 62, for example, and may be displayed on the LCD 7. The user may look at the screen that is displayed on the LCD 7, may select the embroidery pattern that is to be sewn, and may set the selection. In the main processing, processing is performed for sewing the embroidery pattern on the sewing object (not shown in the drawings) that is held by the embroidery frame (not shown in the drawings). A specific example is considered in which thread spools with the thread colors that are shown in FIG. 5 are associated with the needle bars 31 with the needle bar numbers 1 to 10, respectively, at the time when the main processing is started. The thread colors for the thread spools that are associated with the needle bars 31 indicate the colors of the threads that are being supplied to the needle eyes 37 of the needles 35 that are attached to the lower ends of the needle bars 31. As shown in FIG. 5, the colors of light brown, green, blue, orange, tangerine, red, pink, lilac, electric blue, and black correspond to the needle bars 31 with the needle bar numbers 1 to 10, respectively. For the specific example, a case is considered in which an embroidery pattern has been selected that is to be sewn with threads of the ten colors that are shown in FIG. 6. As shown in FIG. 6, the thread colors for sewing the embroidery pattern, in the order of sewing, are light brown, emerald green, lime green, yellow, tangerine, red, pink, lilac, electric blue, and black. The program that causes the individual processing steps that are shown in the flowchart in FIG. 4 to be performed is stored in the ROM 62 that is shown in FIG. 3, and the CPU 61 may execute the program.

Figure 4:
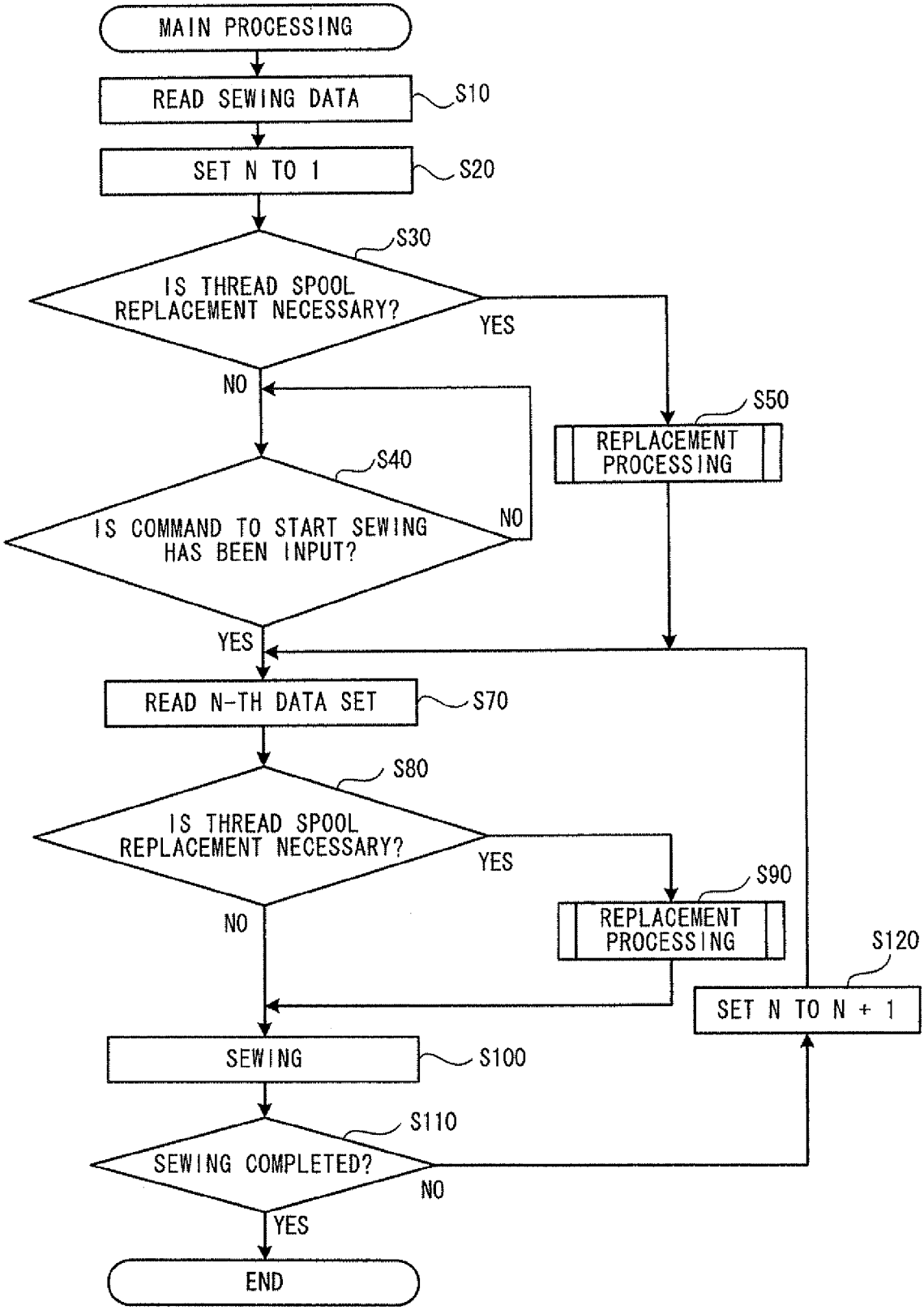
FIG. 4 is a flowchart of main processing.

As shown in FIG. 4, in the main processing, first, the sewing data for sewing the embroidery pattern that has been selected are read out from the ROM 62, and the sewing data that have been read out are stored in the RAM 63 (Step S10). The sewing data may be known data and include a plurality of single-stitch data sets. The single-stitch data set includes data for specifying an amount of the movement of the embroidery frame and data for specifying a color for a thread spool. Next, a variable N is set to 1, and the variable N that has been set is stored in the RAM 63 (Step S20). The variable N is a variable for reading out the single-stitch data sets that are included in the sewing data in accordance with the sewing order.

The colors for the thread spools that are associated with the needle bars 31 are compared to the acquired sewing data, and a determination is made as to whether there is any thread spools that need to be replaced (Step S30). In the present embodiment, when the number of the thread colors that are needed in order to sew the selected embroidery pattern is not less than the number of the needle bars 31, a case in which the number of the thread colors in which the embroidery pattern can be sewn continuously in accordance with the sewing order is less than the number of the needle bars 31 is deemed to be a case in which it is necessary to replace a thread spool. When the number of the thread colors that are needed in order to sew the selected embroidery pattern is less than the number of the needle bars 31, a case in which the number of the thread colors in which the embroidery pattern can be sewn continuously is less than the number of the thread colors that are needed in order to sew the embroidery pattern is deemed to be a case in which it is necessary to replace a thread spool. The thread colors for the thread spools that are associated with the needle bars 31 are stored in the EEPROM 64. In the specific example, the number of the thread colors in which the embroidery pattern can be sewn continuously in accordance with the sewing order is one, which is less than ten, the number of the needle bars 31 (YES at Step S30). In this case, replacement processing is performed (Step S50). The replacement processing is processing that prompts the user to replace a thread spool.

Figure 7:
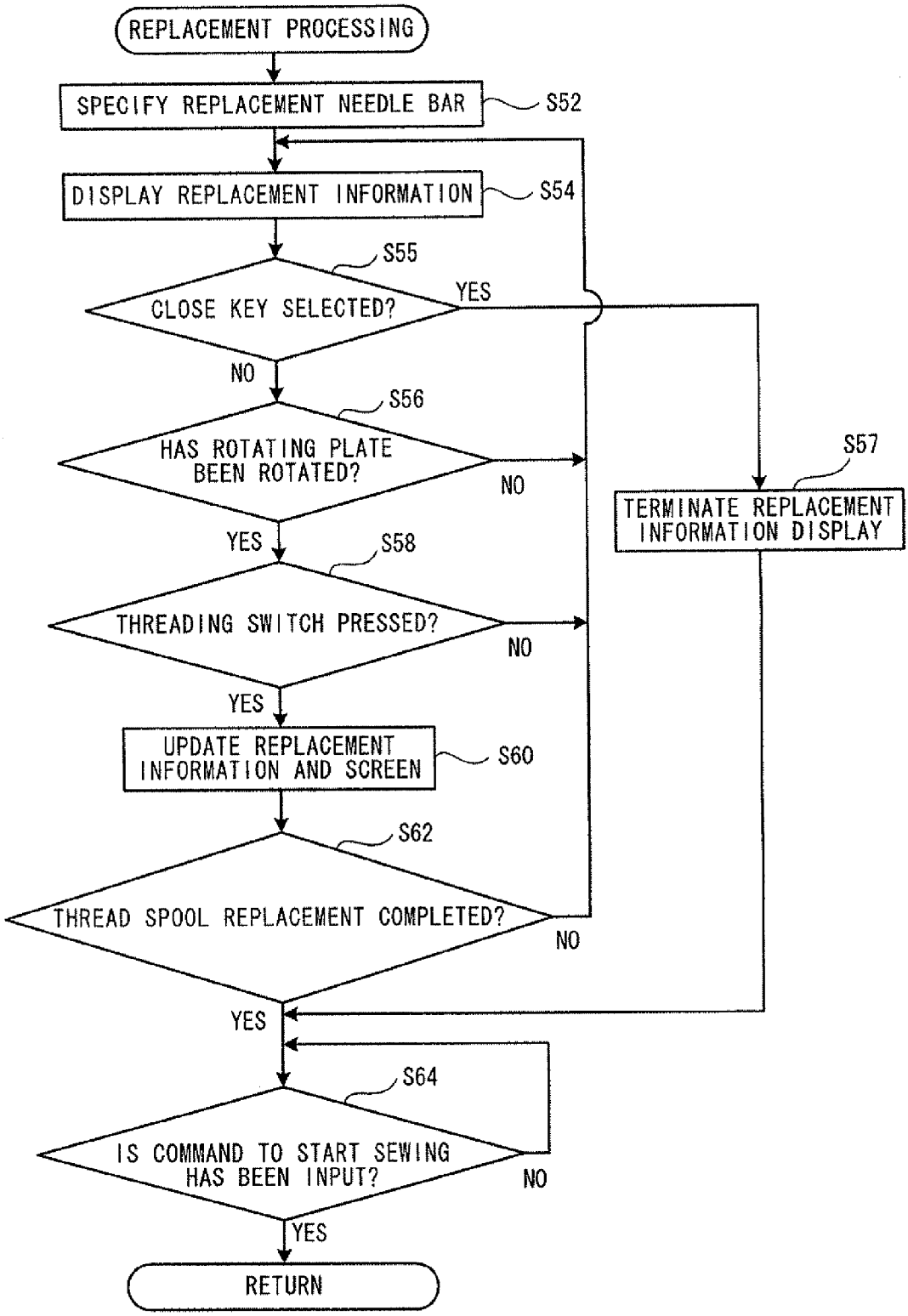
FIG. 7 is a flowchart of replacement processing that is performed by the main processing in FIG. 4.

The replacement processing will be explained in detail with reference to FIG. 7. As shown in FIG. 7, in the replacement processing, first, a replacement needle bar is specified, and the specified replacement needle bar is stored in the RAM 63 (Step S52). The replacement needle bar is a needle bar for which a thread spool needs to be replaced. In the specific example, the number of the thread colors that are necessary in order to sew the embroidery pattern, as shown in FIG. 6, is ten, which is equal to the number (ten) of the needle bars 31. Therefore, in the specific example, the needle bars 31 with the needle bar numbers 2 to 4, with which are associated thread spools for thread colors that are not thread colors that are necessary in order to sew the embroidery pattern, are specified as the replacement needle bars. The thread colors for the replacement thread spools (the thread spools that are to be placed for replacement) are respectively assigned to the replacement needle bars. The thread colors for the replacement thread spools are the thread colors that are necessary in order to sew the embroidery pattern and are thread colors for which the thread spools have not been associated with the needle bars 31. In the specific example, as the thread colors for the replacement thread spools, emerald green, lime green, and yellow are assigned to the needle bars 31 with the needle bar numbers 2, 3, and 4, respectively, for example.

Figure 8:
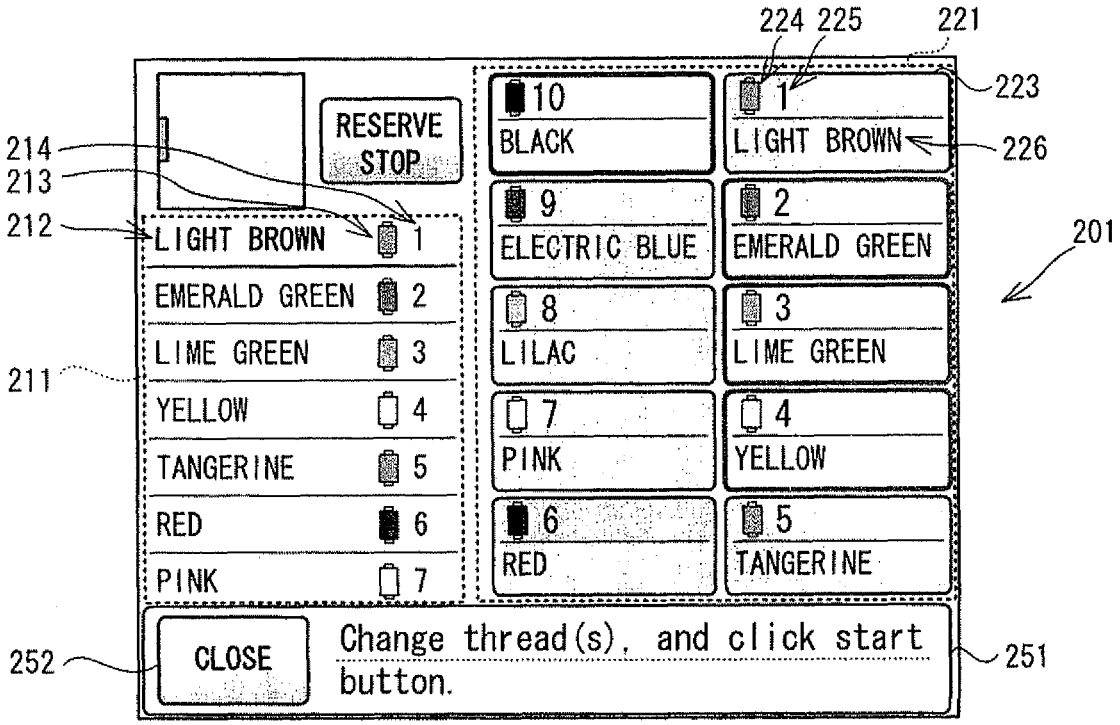
FIG. 8 is an explanatory figure of a screen 201 that is displayed on a liquid crystal display 7.

A control signal is output to the drive circuit 135, and replacement information is displayed on the LCD 7 (Step S54). The replacement information is information that pertains to the replacement needle bars. The replacement information in the present embodiment is information in which a replacement needle bar is associated with a thread color for a replacement thread spool. The replacement information in the present embodiment may be displayed as shown on a screen 201 in FIG. 8, for example. In FIG. 8, the screen 201 is shown in black and white, but the screen 201 may be actually displayed in color.

As shown in FIG. 8, a sewing order display area 211, a thread change display area 221, and a message display area 251 are displayed on the screen 201. In the sewing order display area 211, the thread colors for the thread spools and the needle bar numbers 214 for the needle bars 31 that are associated with the thread colors for the thread spools are displayed in the sewing order from top to bottom. The thread colors for the thread spools are displayed in the form of thread color names 212 for the thread spools and thread spool illustrations 213 with the thread colors for the thread spools. In the thread change display area 221, a display area 223 is provided for each of the needle bars 31. In each of the display areas 223, the information is displayed that includes a needle bar number 225, a thread color name 226 for the thread spool that is associated with the needle bar 31 that is indicated by the needle bar number 225, and a thread spool illustration 224 of the thread color for the thread spool. In the message display area 251, a close key 252 and a message that prompts the user to replace the thread spools are displayed. The message display area 251 is displayed until the close key 252 is selected.

On the screen 201, the display forms in the display areas 223 are different for the replacement needle bars, the sewing needle bar, and the other needle bars. The sewing needle bar is the needle bar that is currently set to be driven by the needle bar drive mechanism 32. In the specific example in FIG. 8, the sewing needle bar is the needle bar with the needle bar number 10. The other needle bars are the needle bars 31 that are other than the replacement needle bars and the sewing needle bar. Specifically, the display forms in the display areas 223 may be as hereinafter described. In the display areas 223 for the other needle bars, the color of the frames is black, and the color of the backgrounds is gray. In the display areas 223 for the replacement needle bars, the color of the frames is red, the frames are thicker than the frames of the display areas 223 for the other needle bars, and the color of the backgrounds is white. In the display area 223 for the sewing needle bar, the color of the frame is blue, the frame is thicker than the frames of the display areas 223 for the other needle bars, and the color of the background is pale aqua. In the display area 223 for the sewing needle bar in a case where the sewing needle bar has been specified as a replacement needle bar, the color of the frame is red, the frame is thicker than the frames of the display areas 223 for the other needle bars, and the color of the background is pale aqua, although not shown in the drawings. As shown in FIG. 8, the display areas 223 for the replacement needle bars (needle bar numbers 2 to 4) and the display area 223 for the sewing needle bar (needle bar number 10) are more noticeable than the display areas for the other needle bars. Thus, in the present embodiment, the replacement information is displayed in a form that is different from a display form for the information that pertains to the needle bars other than the replacement needle bar.

Figure 10:
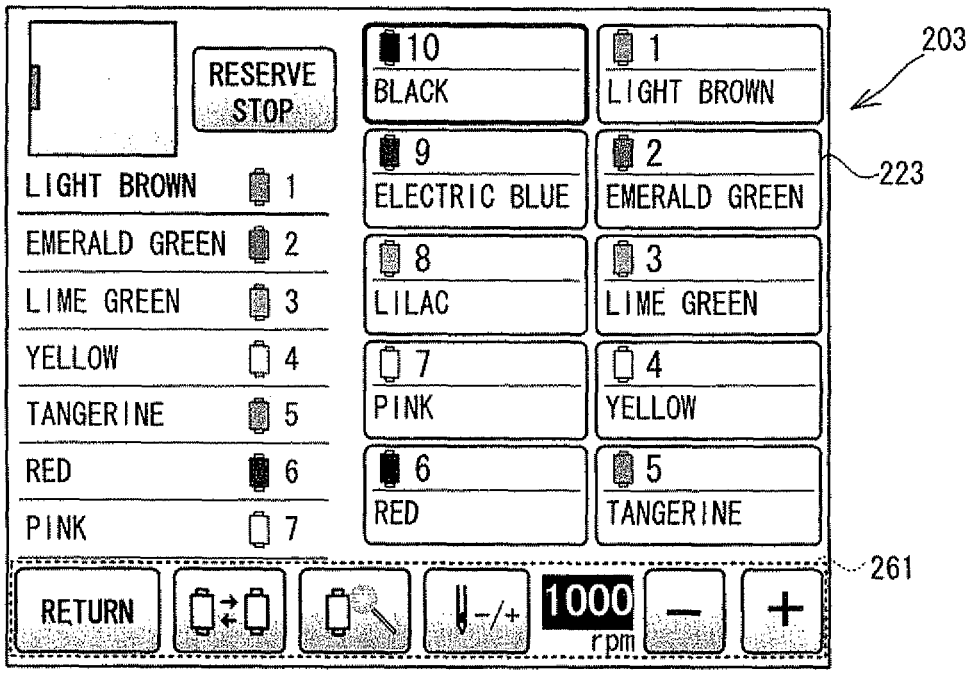
FIG. 10 is an explanatory figure of a screen 203 that is displayed on the liquid crystal display 7.

After the replacement information has been displayed on the LCD 7 (Step S54), a determination is made as to whether the close key 252 has been selected (Step S55). If the close key 252 has been selected (YES at Step S55), the display of the replacement information is terminated (Step S57). In the specific example, a screen 203 that is shown in FIG. 10 may then be displayed on the LCD 7, for example. In FIG. 10, the backgrounds of the display areas 223 for the other needle bars have been changed from gray to white. An operation key display area 261 is being displayed instead of the message display area 251. In the operation key display area 261, a plurality of operation keys are displayed. The plurality of the operation keys are used for inputting various types of commands. In FIG. 10, the display forms of the display areas 223 that correspond to the individual needle bars 31 are the same as the display forms of the display areas 223 when the sewing is in progress. After the display of the replacement information has been terminated (Step S57), a determination is made as to whether a command to start the sewing has been input (Step S64).

If the close key 252 has not been selected (NO at Step S55), processing is performed that determines whether the replacement of the thread spools has been performed. One of a first method and a second method that are hereinafter described in detail may be used as the main method for performing the replacement of the thread spools. In the first method, the user may remove the thread spool that is to be replaced from the spool stand 12 and may place the replacement thread spool on the spool stand 12. Next, the user may take the thread that extends from the thread spool that has been placed on the spool stand 12 and may pass the thread through the thread guide path that was described above. The user may perform a panel operation to move to the sewing position the needle bar 31 for which the thread spool replacement is to be performed. Thereafter, the user may press the threading switch 42 to pass the upper thread 15 through the needle eye 37 of the needle 35 that is attached to the lower end of the needle bar 31.

In the second method, the user may take the upper thread 15 that extends from the thread spool that is to be replaced and may use scissors to cut the thread between the thread spool 13 and the thread guide 17. After placing the replacement thread spool on the spool stand 12, the user may tie the end of the thread from the replacement thread spool that has been placed on the spool stand 12 and the end of the thread that was being used before the thread spool was replaced. Next, the user may hold the thread that was being used before the thread spool was replaced in one hand from below the needle bar thread guide 43 and may pull the thread until the knot where the thread is tied to the thread from the replacement thread spool reaches the needle 35. The user then may use scissors to cut off the thread that was being used before the thread spool was replaced, including the knot. The user may perform a panel operation to move to the sewing position the needle bar 31 for which the thread spool replacement is to be performed. Thereafter, the user may press the threading switch 42 to pass the upper thread 15 through the needle eye 37 of the needle 35 that is attached to the lower end of the needle bar 31. In the second method, unlike in the first method, the extra portion of the thread that was being used before the thread spool was replaced may be utilized (and discarded). However, the thread from the replacement thread spool can be easily positioned in the correct thread guide path. In both the first method and the second method, the rotating plate 34 of the tensioner 18 may be rotated in the process of the thread spool replacement, and the threading switch 42 may be pressed. Therefore, the sewing machine 1 according to the present embodiment detects whether a thread spool has been replaced, as described below, by detecting the rotation of the rotating plate 34 and the pressing of the threading switch 42. In the specific example, a case is assumed in which the thread spool that corresponds to the needle bar 31 with the needle bar number 2 is replaced.

Based on an electrical signal that is input from the rotation detector 33, a determination is made as to whether any of the ten rotating plates 34 that respectively correspond to the ten needle bars 31 have been rotated (Step S56). In the specific example, in a case where the rotating plate 34 that corresponds to the needle bar 31 with the needle bar number 2 has been rotated (YES at Step S56), the needle bar 31 with the needle bar number 2 is specified as the needle bar 31 that corresponds to the rotating plate 34 that has been rotated. Next, the specified needle bar 31 with the needle bar number 2 may be selected by a panel operation, then a determination is made as to whether the threading switch 42 has been pressed (Step S58). Specifically, a determination is made as to whether the threading switch 42 has been pressed within a specified period of time (for example, five minutes) after the rotation of the rotating plate 34 has been detected by the processing at Step S56.

Figure 9:
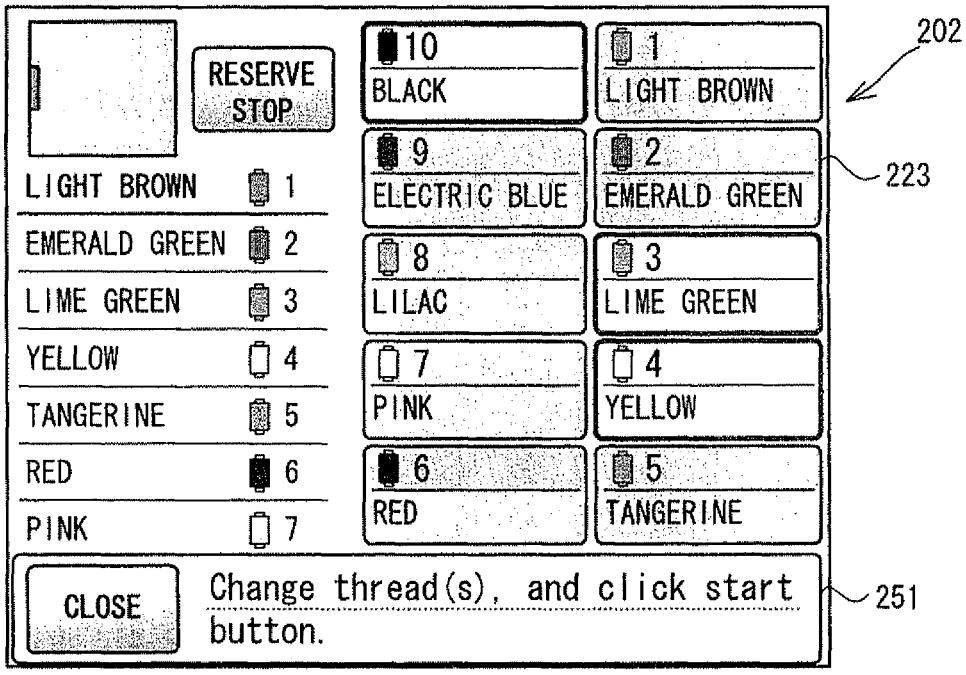
FIG. 9 is an explanatory figure of a screen 202 that is displayed on the liquid crystal display 7.

In the specific example, in a case where the threading switch 42 has been pressed (YES at Step S58), the needle bar 31 with the needle bar number 2, which was specified by the processing at Step S56, is specified as a replacement-completed needle bar, and the replacement information is updated (Step S60). The replacement-completed needle bar is a needle bar, among the replacement needle bars, for which the thread spool has been replaced. Specifically, the CPU 61 may update the replacement information by deleting, from the needle bars 31 with the needle bar numbers 2 to 4, which were specified as the replacement needle bars, the needle bar 31 with the needle bar number 2, which has been specified as the replacement-completed needle bar. Based on the updated replacement information, a control signal may be output to the drive circuit 135, and a screen that is shown in FIG. 9 may be displayed. In FIG. 9, the display area 223 that corresponds to the needle bar 31 with the needle bar number 2, which has been specified as the replacement-completed needle bar, is displayed in the display form that corresponds to the other needle bars, as described above. Next, a determination is made as to whether the replacement of the thread spools has been completed (Step S62). Specifically, in a case where the number of the replacement needle bars has become zero due to the processing at Step S60, a determination is made that the replacement of the thread spools has been completed.

In a case where none of the rotating plates 34 have been rotated (NO at Step S56), in a case where the threading switch 42 has not been pressed (NO at Step S58), or in a case where the replacement of the thread spools has not been completed (NO at Step S62), the processing returns to Step S54. If the replacement of the thread spools has been completed (YES at Step S62), the CPU 61 waits while a command to start the sewing has not been input (NO at Step S64). The command to start the sewing may be input when the start/stop switch 41 is pressed, for example. If the command to start the sewing has been input (YES at Step S64), the replacement processing is terminated. The processing returns to the main processing that is shown in FIG. 4, and the processing at Step S70, which is described below, is performed.

In the processing at Step S30, if it is determined that the replacement of the thread spools is not necessary (NO at Step S30), the CPU 61 waits while the command to start the sewing has not been input (NO at Step S40), in the same manner as in the processing at Step 64 in the replacement processing that is shown in FIG. 7. If the command to start the sewing has been input (YES at Step S40), the N-th single-stitch data set that is included in the sewing data that were read out from the ROM 62 by the processing at Step S10 is read out from the RAM 63 (Step S70). Next, if the replacement of a thread spool is necessary in order to form a stitch according to the N-th single-stitch data set that has been read out (YES at Step S80), the replacement processing that is shown in FIG. 7 is performed (Step S90), in the same manner as in the processing at Step S50. In the processing at Step S90, the replacement processing is performed such that the sewing can be performed continuously in accordance with the sewing order based on the N-th and subsequent single-stitch data sets for as long a period as possible. Specifically, if the number of the thread colors that are necessary in order to sew the selected embroidery pattern based on the N-th and subsequent single-stitch data sets is not less than the number of the needle bars 31, the replacement processing is performed such that the sewing can be performed continuously for the number of the thread spools that is to be placed in the sewing machine 1. If the number of the thread colors that are necessary in order to sew the selected embroidery pattern based on the N-th and subsequent single-stitch data sets is less than the number of the needle bars 31, the replacement processing is performed such that the number of the thread colors that can be sewn continuously becomes the number of the thread colors that are necessary in order to sew the embroidery pattern.

If the replacement of a thread spool is not necessary (NO at Step S80), as well as following the replacement processing (Step S90), the sewing is performed based on the N-th single-stitch data set that has been read out (Step S100). Specifically, in accordance with the N-th single-stitch data set, a control signal is output to the drive circuit 123, and the needle bar 31 that is associated with the thread spool for the thread color for sewing a stitch that is specified by the N-th single-stitch data set is moved to the sewing position. In accordance with the N-th single-stitch data set, control signals are output to the drive circuits 131, 133, so that the embroidery frame (not shown in the drawings) is moved. A control signal is output to the drive circuit 121, so that the sewing machine motor 122 is operated. Next, if the N-th single-stitch data set that has been read out is not the single-stitch data set for the last stitch in the sewing order, among the single-stitch data sets that are included in the sewing data (NO at Step S110), the value of N is incremented, and the incremented N is stored in the RAM 63 (Step S120). Next, the processing returns to Step S70. If the N-th single-stitch data set that has been read out is the single-stitch data set for the last stitch in the sewing order (YES at Step S110), the main processing is terminated.

According to the sewing machine 1, by using the LCD 7, the user can easily check which of the needle bars are the replacement needle bars, even in a case where there is a plurality of the replacement needle bars. Therefore, the user can identify all of the replacement needle bars more easily than in a case where the replacement needle bars are specified by checking each of a plurality of display portions that are provided for each of the needle bars 31. During the replacement of the thread spools, the sewing machine 1 may specify the replacement-completed needle bar by taking advantage of the fact that a rotating plate 34 is rotated by the work of the user in placing in the sewing machine 1 an upper thread 15 that is supplied from a thread spool, as well as the fact that the threading mechanism 126 is operated for passing the upper thread 15 through a needle eye 37 of a needle 35. Therefore, during the replacement of the thread spool, the sewing machine 1 may specify the replacement-completed needle bar more precisely than in a case where the replacement-completed needle bar is specified by taking advantage of one of the fact that the rotating plate 34 is rotated and the fact that the threading mechanism 126 is operated. The sewing machine 1 may detect the state of the thread spool replacement and may update the replacement information that is displayed on the LCD 7. Therefore, by checking the LCD 7, the user may distinguish reliably between a replacement needle bar and a replacement-completed needle bar. Therefore, according to the sewing machine 1, a situation may be avoided in which a user replaces a thread spool for the replacement-completed needle bar by mistake because the user is unable to distinguish between the replacement needle bar and the replacement-completed needle bar. During the replacement of the thread spool, the sewing machine 1 may vary the form of the display of the display areas 223 that correspond to the individual needle bars 31 such that the user may distinguish between the replacement needle bar and the other needle bar. The display positions of the display areas 223 that correspond to the individual needle bars 31 may be the same during the sewing as they are during the replacement of the thread spool. Therefore, the user may specify the replacement needle bar more easily than in a case where the display positions for the replacement needle bar are different during the sewing from what they are during the replacement of the thread spool.

The sewing machine 1 according to the present disclosure is not limited to the embodiment that has been described above, and various modifications may be made within the scope of the claims of the present disclosure. For example, the modifications from (A) to (D) below may be made as desired.

(A) The configuration of the sewing machine 1 can be modified as desired. For example, the number of the needle bars 31 that the sewing machine 1 includes is not limited to ten and may be any number that is greater than one. The sewing machine 1 may include a display device such as an organic electroluminescence display, electronic paper, or the like instead of the LCD 7. The command to pass the upper thread 15 through the needle eye 37 of the needle 35 may be input by an operation device other than the threading switch 42 (for example, the touch panel 8). The threading mechanism 126 and the threading switch 42 may be provided separately for each of the needle bars 31.

(B) The main processing that is shown in FIG. 4 may be modified as desired. Specifically, the modifications that are described from (B-1) to (B-3) below may be made.

(B-1) The method for specifying the replacement needle bar may be modified as desired. For example, the method may be modified such that a needle bar for which the thread spool is not allowed to be replaced can be set in accordance with a command from the user. The thread color for the replacement thread spool may be assigned to the replacement needle bar in accordance with a command from the user.

(B-2) The method for specifying the replacement-completed needle bar may be modified as desired. For example, in the replacement processing that is shown in FIG. 7, the processing at Step S58 may be omitted. In that case, the replacement-completed needle bar may be specified by determining whether the thread spool has been replaced, based on whether the rotating plate 34 has been rotated. In that case, it is desirable for the rotating of the rotating plate 34 in a specified direction to be detected. The specified direction would be the direction in which the rotating plate 34 rotates in a case where the upper thread 15 is pulled toward the needle 35 from the thread spool. This is because, in a case where the thread spool is replaced by the first method that was described above, the rotating plate 34 may be rotated in the process of removing the thread from the thread spool before the thread spool is replaced. In this case, the rotating plate 34 may be rotated in the opposite direction from the specified direction, that is, the upper thread 15 is pulled toward the thread spool from the needle 35. Therefore, by detecting that the rotating plate 34 has been rotated in the specified direction, the sewing machine 1 can distinguish between a case in which the replacement thread spool has been placed and a case in which the thread of the thread spool before the thread spool is replaced has been removed. Even in this case, the replacement-completed needle bar can be accurately specified. In the replacement processing that is shown in FIG. 7, the processing at Step S56 may be omitted. In that case, the replacement-completed needle bar may be specified by determining whether the thread spool has been replaced, based on whether the command to pass the upper thread 15 through the needle eyes 37 has been input. In that case, the replacement-completed needle bar can be accurately specified by taking advantage of the fact that the threading mechanism 126 has been operated. For example, the sewing machine 1 may include a thread cutting key, a thread cutting drive circuit, and a thread cutting mechanism. The thread cutting key and the thread cutting drive circuit may be connected to the input/output interface 66 (refer to FIG. 3). The thread cutting key may be used to issue a command to operate the thread cutting mechanism. The thread cutting mechanism may be used for cutting the upper thread 15 (refer to FIG. 1) before the thread spool is replaced. When the thread cutting key is operated, an electrical signal from the thread cutting key may be input to the control portion 60 (refer to FIG. 3). Then, the thread cutting drive circuit may drive the threading cutting mechanism in accordance with a control signal from the control portion 60. In a case where the sewing machine 1 includes such a configuration, CPU 61 (refer to FIG. 3) may determine whether the thread spool has been replaced, based on whether the thread cutting key has been operated, instead of performing the processing at Steps S56 and S58 in the replacement processing. The replacement-completed needle bar may be specified based on a command from the user. The method for specifying the replacement-completed needle bar may be a method that the user can select from among a plurality of types of methods that are registered in advance. In those cases, the processing would be simpler than in the embodiment that is described above.

(B-3) In a case where the sewing machine 1 has detected that a thread spool that is associated with a needle bar 31 that is not a replacement needle bar has been replaced by mistake, the sewing machine 1 may display a warning message on the LCD 7 to alert the user, for example.

(C) The replacement information may be modified as desired. For example, a thread color for a replacement thread spool may be displayed by one of an illustration 224 and a thread color name 226. The thread color for the replacement thread spool may be displayed in the form of other information, such as a part number or the like. Both the thread color for the thread spool that is to be replaced and the thread color for the replacement thread spool may be included in the replacement information.

Figure 11:
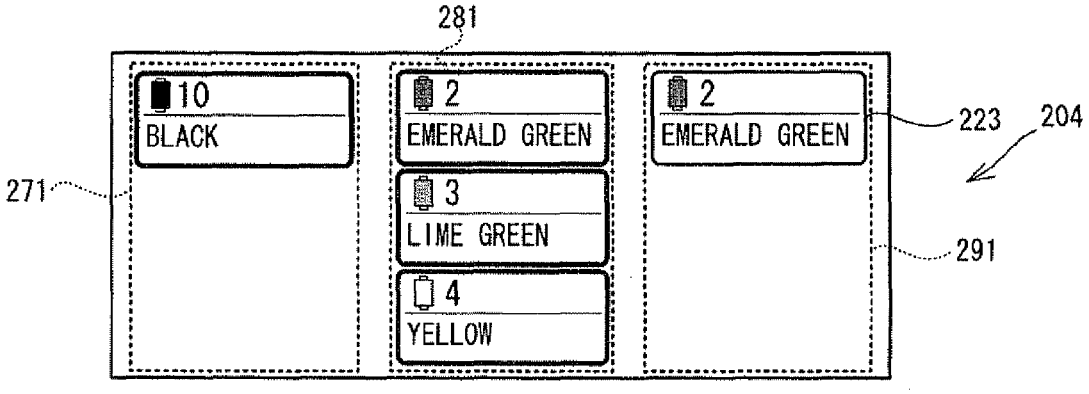
FIG. 11 is an explanatory figure of a screen 204 that is displayed on the liquid crystal display 7.

(D) The forms in which the replacement information and the information that pertains to the replacement-completed needle bar are displayed on the LCD 7 may be modified as desired. For example, the result of the specifying of the replacement-completed needle bar may be displayed separately from the replacement information. Specifically, a sewing needle bar display area 271, a replacement information display area 281, and a replacement-completed information display area 291 may be provided, as on a screen 204 that is shown in FIG. 11, and the information that pertains to the replacement-completed needle bars may be displayed separately from the replacement information. The screen 204 that is shown in FIG. 11 is a screen that corresponds to a screen 202 that is shown in FIG. 9. The display area 223 that corresponds to the sewing needle bar is displayed in the sewing needle bar display area 271. The display areas 223 that correspond to the replacement needle bars are displayed as the replacement information in the replacement information display area 281. The display area 223 that corresponds to the replacement-completed needle bar is displayed in the replacement-completed information display area 291 as the result of the specifying of the replacement-completed needle bar.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a plurality of needle bars a lower end of each of which a needle can be attached to, the needle having a needle eye through which can be passed an upper thread that is supplied from a thread spool;

a display portion that is configured to display various information;

a plurality of tensioners that correspond to the plurality of needle bars, each of the plurality of tensioners having a rotating plate that is configured to impart tension to the upper thread;

a threading mechanism that is configured to pass an upper thread through a needle eye of a needle that is attached to a needle bar that has been selected from among the plurality of needle bars;

an operation portion that is configured to input an instruction to operate the threading mechanism;

a first display control portion that is configured to cause the display portion to display replacement information, the replacement information being information pertaining to a replacement needle bar that corresponds to a thread spool for which replacement is necessary and that is at least one of the plurality of needle bars;

a specifying portion that is configured to specify a replacement-completed needle bar, during a period in which the replacement information is being displayed on the display portion, by: (i) detecting that a rotating plate has been rotated in a specified direction by an upper thread that is supplied from a thread spool that has been placed after replacement, and (ii) determining that the operation portion has been operated, the specified direction being a direction in which the rotating plate is rotated in a case where the upper thread is pulled toward the needle from the thread spool, the replacement-completed needle bar being a needle bar: (i) that corresponds to the thread spool that has been placed after replacement, (ii) that corresponds to a tensioner that has the rotating plate that has been rotated in the specified direction, and (iii) to which is attached the needle that has the needle eye through which the upper thread has been passed by the threading mechanism in a case where the operation portion has been operated; and a second display control portion that is configured to cause the display portion to display a result that has been specified by the specifying portion.

2. The sewing machine according to claim 1, wherein the replacement information is information in which the replacement needle bar is associated with a thread color for the thread spool that is to be placed after replacement, the second display control portion updates the replacement information that is being displayed on the display portion in a case where the replacement-completed needle bar has been specified by the specifying portion, and the first display control portion and the second display control portion cause the display portion to display the replacement information in a different form from information that pertains to a needle bar, of the plurality of the needle bars, that is not the replacement needle bar.

3. A computer program product stored on a non-transitory computer-readable medium, comprising instructions for causing a computer of a sewing machine to execute the steps of:

inputting an instruction to operate a threading mechanism of the sewing machine, the threading mechanism being configured to pass an upper thread through a needle eye of a needle that is attached to a needle bar that has been selected from among a plurality of needle bars;

causing a display portion of the sewing machine to display replacement information, the display portion being configured to display various information, the replacement information being information pertaining to a replacement needle bar that corresponds to a thread spool for which replacement is necessary and that is at least one of the plurality of needle bars of the sewing machine, a needle can be attached to a lower end of each of the plurality of needle bars, the needle having a needle eye through which can be passed an upper thread that is supplied from a thread spool;

specifying a replacement-completed needle bar, during a period in which the replacement information is being displayed on the display portion, by: (i) detecting that a rotating plate has been rotated in a specified direction by an upper thread that is supplied from a thread spool that has been placed after replacement, and (ii) determining that the instruction to operate the threading mechanism has been input, the specified direction being a direction in which a rotating plate is rotated in a case where the upper thread is pulled toward the needle from the thread spool, the replacement-completed needle bar being a needle bar: (i) that corresponds to the thread spool that has been placed after replacement, (ii) that corresponds to a tensioner that has the rotating plate that has been rotated in the specified direction, and (iii) to which is attached the needle that has the needle eye through which the upper thread has been passed by the threading mechanism in a case where the instruction to operate the threading mechanism has been input, the tensioner being one of a plurality of tensioners of the sewing machine, each of the plurality of tensioners having a rotating plate that is configured to impart tension to the upper thread; and causing the display portion to display a result that has been specified.

4. The computer program product according to claim 3, wherein the replacement information is information in which the replacement needle bar is associated with a thread color for the thread spool that is to be placed after replacement, the replacement information that is being displayed on the display portion is updated in a case where the replacement-completed needle bar has been specified, and the replacement information is displayed on the display portion in a different form from information that pertains to a needle bar, of the plurality of the needle bars, that is not the replacement needle bar.

* * * * *